US005473805A

United States Patent [19]

Wille

[11] Patent Number: 5,473,805

[45] Date of Patent: Dec. 12, 1995

[54] TOOL FOR SETTING BLIND RIVETS

[75] Inventor: Lothar Wille, Mörfelden-Walldorf, Germany

[73] Assignee: Gesipa Blindniettechnik GmbH, Frankfurt am Main, Germany

[21] Appl. No.: 177,808

[22] Filed: Jan. 6, 1994

Related U.S. Application Data

[63] Continuation of Ser. No. 925,444, Aug. 11, 1992, abandoned.

[30] Foreign Application Priority Data

Aug. 12, 1991 [DE] Germany ..... 41 26 602

[51] Int. Cl.[6] ..... B21J 15/26

[52] U.S. Cl. ..... 29/243.526; 29/243.53; 227/55

[58] Field of Search ..... 227/55, 131; 29/243.526, 29/243.53; 72/391.6

[56] References Cited

U.S. PATENT DOCUMENTS

| | | | |
|---|---|---|---|
| 3,095,106 | 6/1963 | Morrison | 29/243.526 |
| 3,127,045 | 2/1964 | Tschantz | 29/243.526 |
| 3,375,883 | 10/1965 | Schädlich | 173/170 |
| 3,906,775 | 9/1975 | Benimetzki | 29/243.526 |
| 4,063,443 | 12/1977 | Yarbrough | 29/293.526 |
| 4,085,337 | 4/1978 | Moeller | 29/243.526 X |

FOREIGN PATENT DOCUMENTS

| | | | |
|---|---|---|---|
| 0062869 | 10/1982 | European Pat. Off. | 29/243.526 |
| 0116954 | 8/1984 | European Pat. Off. . | |
| 49-127274 | 12/1974 | Japan . | |
| 2-137638 | 5/1990 | Japan . | |
| 9111279 | 8/1991 | WIPO | 29/243.526 |

*Primary Examiner*—Rinaldi I. Rada
*Attorney, Agent, or Firm*—Darby & Darby

[57] ABSTRACT

A power tool for the setting of blind rivets has a reversible electric motor which can reciprocate a gripper for the mandrel of a blind rivet through a transmission employing a rotary nut driven by the motor and a spindle which reciprocates the gripper in response to rotation of the nut. The motor is permanently connected with the spindle, and hence with the gripper, and the ratio of the transmission including the nut and the spindle is not dependent upon the position of the gripper. Such construction enhances the comfort to the operator of the power tool. The electric circuit for the motor is designed in such a way that the motor is disconnected from a portable energy source and is braked prior to a reversal in the direction of rotation of its output element.

21 Claims, 2 Drawing Sheets

TOOL FOR SETTING BLIND RIVETS

This is a continuation of application Ser. No. 07/925,444, filed Aug. 11, 1992, now abandoned.

BACKGROUND OF THE INVENTION

The invention relates to improvements in riveting tools, and more particularly to improvements in tools for setting so-called blind rivets.

European Pat. No. 0 116 954, granted May 6, 1987 to Totsu for "A riveting motor tool", discloses a power tool which can set blind rivets and employs an electric motor serving to rotate a pinion having three equidistant teeth and meshing with a toothed rack having a single tooth. When the pinion is driven, one of its teeth engages the tooth of the rack and pushes the rack rearwardly whereby the rack entrains a gripper which engages the mandrel of a blind rivet and causes the mandrel to break, i.e., to become severed from the so-called bulge portion or head at the front end of an intact mandrel. The tooth of the pinion becomes disengaged from the tooth of the rack upon rotation of the pinion through a predetermined angle so that a coil spring is free to propel the rack and the gripper back to their starting or extended positions.

The power tool of Totsu exhibits a number of drawbacks. First of all, the ratio of the rack-and-pinion transmission between the motor and the gripper is dependent upon the starting axial position of the rack. In fact, the ratio is least satisfactory at the time the pinion is in the process of severing the mandrel of an applied blind rivet through the medium of the rack and gripper, i.e., at a time when the rack is to transmit a maximal pulling force in order to break or sever the mandrel. The reason is that the lever arm of the transmission is least satisfactory in that axial position of the rack when the gripper is supposed to sever the mandrel. This renders it necessary to ensure that the motor can apply a pronounced torque with attendant consumption of substantial amounts of electrical energy. Furthermore, the motor must overcome the resistance of the mandrel to severing by the gripper as well as the resistance of the spring which is used to bias the rack and the gripper back to their starting or extended positions. In other words, the spring stores energy while the motor is operated in a direction to move the gripper from its extended position for the purpose of severing a mandrel. The resistance of the spring to further deformation by the rack increases as the gripper moves in a direction to sever the mandrel.

If the mandrel does not break before a tooth of the pinion becomes disengaged from the single tooth of the rack, the disengagement of the pinion from the rack results in abrupt propulsion of the rack and gripper back to their starting positions with attendant pronounced wear upon such parts and upon the guide means therefor. In addition, the mating teeth of the pinion and the rack also undergo extensive wear. Abrupt disengagement of the pinion from the rack results in the generation of a pronounced shock which must be taken up by the hand holding the housing of the patented power tool.

A further drawback of the patented power tool is that the rack must complete a full rearward stroke before it becomes disengaged from the pinion, irrespective of whether the mandrel breaks during an initial stage or during a later stage of movement of the rack from its extended position. The rack must reassume the starting position in order to maintain the gripper in a position in which the gripper is ready to receive the mandrel of a fresh blind rivet. Any rearward movement of the rack which takes place upon completed severing of a mandrel is undesirable because the motor must consume considerable amounts of energy (the motor must then rotate the pinion against the resistance of the progressively stressed spring). Abrupt propulsion of the rack and gripper back to their extended positions upon disengagement of the pinion from the rack (i.e., after the rack has completed a full rearward stroke) results in the generation of readily detectable noise and causes shaking and other stray movements of the housing of the patented power tool.

The power tool of Totsu is operated by a motor which receives energy from an accumulator or from a battery. If the supply of energy in the battery or in the accumulator is nearly exhausted so that the motor is incapable of causing the rack and the gripper to sever a mandrel, a specific embodiment of the patented tool is designed to employ a reversible electric motor which can move the rack and the gripper back to their extended positions in which the gripper can be disengaged from the still intact mandrel.

U.S. Pat. Nos. 3,375,883 and 3,127,045 disclose power tools for the application of blind rivets wherein the transmission which converts rotary movements of the output element of an electric motor into translatory movements of the gripper for the mandrel of a blind rivet comprises an eccentric and a connecting rod. A clutch is provided to connect the continuously operated electric motor with the connecting rod. A drawback of such power tools is that one-half of each rearward stroke of the gripper must take place under highly unsatisfactory circumstances, namely when the lever arm of the transmission is least satisfactory for transmission of motion to the gripper. The mandrel is to be severed during such least satisfactory stage of movement of the connecting rod so that the power tool must employ a strong motor whose energy requirements are high. This ensures that the gripper will be in a position to sever an engaged mandrel irrespective of the momentary condition of the transmission including the eccentric and the connecting rod. The motor is bulky and contributes significantly to the weight of the patented power tool. This, in turn, necessitates the exertion of a considerable effort by the operator of the power tool so that the operator is likely to be exhausted after a relatively short period of use of the patented tool.

U.S. Pat. No. 3,095,106 granted Jun. 25, 1963 to Morrison discloses an automatic rivet setting tool wherein the prime mover is an electric motor which can drive the gripper for the mandrel of a blind rivet through a gear train and a ball screw transmission. The prime mover transmits torque to the feed screw of the transmission. A spring is employed to return the gripper to its starting position upon disengagement of a clutch. Thus, the gripper receives motion from the motor or from the screw.

U.S. Pat. No. 4,085,337 granted Apr. 18, 1978 to Moeller for "Electric drill multi-functional apparatus" discloses an apparatus for setting self-cutting rivets and for performing additional functions including drilling holes for rivets and hammering the rivets. The chuck which drives the rivets must rotate about its axis and must move back and forth in order to drive the mandrel of a rivet into one or more workpieces. The electric motor of the patented apparatus is connected to an outside source of electrical energy by a cable.

OBJECTS OF THE INVENTION

An object of the invention is to provide a power tool which can be utilized for the setting or application of blind rivets and is simpler, more compact and easier to manipulate than presently known tools.

Another object of the invention is to provide a power tool whose energy requirements are low and wherein the movements of the gripper for the mandrel of a rivet are controlled or controllable at all times.

A further object of the invention is to provide a power tool whose manipulation is practically fully automated.

An additional object of the invention is to provide a novel and improved operative connection between the gripper and the prime mover of a power tool for the setting of blind rivets.

Still another object of the invention is to provide a novel and improved transmission between the reversible electric motor and the gripper of the above outlined power tool.

A further object of the invention is to provide a novel and improved control circuit for the electric motor of the above outlined tool.

Another object of the invention is to provide a power tool which can utilize a simple, compact and lightweight housing.

An additional object of the invention is to provide a power tool which can set a large number of rivets by consuming energy supplied by a relatively small portable energy source.

Still another object of the invention is to provide a novel and improved system for evacuation of severed mandrels of blind rivets.

A further object of the invention is to provide the power tool with novel and improved means for collecting severed portions of mandrels of blind rivets.

Another object of the invention is to provide a novel and improved method of automatically returning the gripper of the power tool to its starting position for reception of a fresh mandrel as soon as the setting of a preceding blind rivet is completed.

An additional object of the invention is to provide a novel and improved method of preventing the application of shocks to the housing of the above outlined power tool.

Still another object of the invention is to provide a power tool which generates less noise than heretofore known power tools for the setting of blind rivets.

SUMMARY OF THE INVENTION

The invention is embodied in a power tool which can be utilized with particular advantage for setting blind rivets by tensioning a mandrel of a blind rivet until the mandrel becomes severed. The improved power tool comprises a housing, a mandrel pulling unit which is disposed in the housing and comprises a gripper (e.g., tongs having two or more jaws) movable between an extended position for engagement with a mandrel and a retracted position to sever an engaged mandrel during movement from the extended position, and means for moving the gripper including an electric motor and a transmission which is interposed between the gripper and the motor and has a transmission ratio independent of the position of the gripper. The power tool further comprises means for operating the motor to thereby move the gripper. The motor and the transmission constitute the only means for moving the gripper between its extended and retracted positions, i.e., it is not necessary to provide means for permanently biasing the gripper to the one and/or to the other position.

The transmission preferably comprises a jack screw member, a nut member which mates with the jack screw member, and antifriction rolling elements (e.g., spheres) which are interposed between the two members. One of these members is rotatable by the motor, and the other member is reciprocable with the gripper in response to rotation of the one member. It is presently preferred to rotate the nut member so that the nut member reciprocates the jack screw member. The arrangement can be such that the nut member comprises an external ring gear and the transmission further comprises means (e.g., a gear train) for rotating the gear of the nut member in response to operation of the motor.

The gripper and the jack screw member can define a path for evacuation of a severed mandrel from the pulling unit. Such path can include a longitudinal (for example, axial) passage in the jack screw member. The housing can comprise a tube for evacuation of severed mandrels from the path, and such tube can be telescoped into the passage in such a way that it does not interfere with reciprocation of the jack screw member and of the gripper relative to the tube and relative to the nut member.

The power tool further comprises a hollow mouthpiece or nipple which is provided in the housing and is aligned with the gripper, and a thrust bearing between the mouthpiece and the nut member. The mouthpiece defines an inlet for the introduction of a mandrel to be severed into the gripper. The mouthpiece is disposed at one axial end of the nut member, and the housing can be provided with a cage which at least partially confines the nut member. A second thrust bearing can be installed between the cage and the other axial end of the nut member.

The power tool can further comprise at least one abutment which is reciprocable with the jack screw member and is arrested by the nut member in response to movement of the gripper and the jack screw member to a predetermined position relative to the housing and the nut member.

The motor is preferably a reversible motor and the operating means preferably includes a switch which is actuatable by an operator of the power tool, and a circuit including means for operating the motor in a first direction in response to actuation of the switch and in a second direction in response to termination of actuation of the switch. The circuit preferably further comprises means for short circuiting the motor for a predetermined interval of time in immediate response to termination of actuation of the switch. Such circuit can further comprise at least one signal generating device which is operable by the switch and means for delaying the generation of a signal by the at least one signal generating device in response to operation of the at least one device by the switch. The motor comes to a halt within a first interval of time in response to short circuiting by the short circuiting means, and the delaying means is operative to delay the generation of a signal for a second interval of time which can equal or at least approximate the first interval.

The circuit can comprise two discrete means for short circuiting the motor for predetermined intervals of time in response to termination of actuation of the switch. Each short circuiting means can comprise a switchover device.

The power tool further comprises an energy source for the motor, and the operating means can comprise at least one limit switch for disconnecting the motor from the energy source in response to movement of the jack screw member to a predetermined position. The at least one limit switch can comprise means for deactivating the delaying means in response to movement of the jack screw member to the predetermined position. The at least one signal generating device can be operated by the at least one limit switch.

The novel features which are considered as characteristic of the invention are set forth in particular in the appended claims. The improved power tool itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
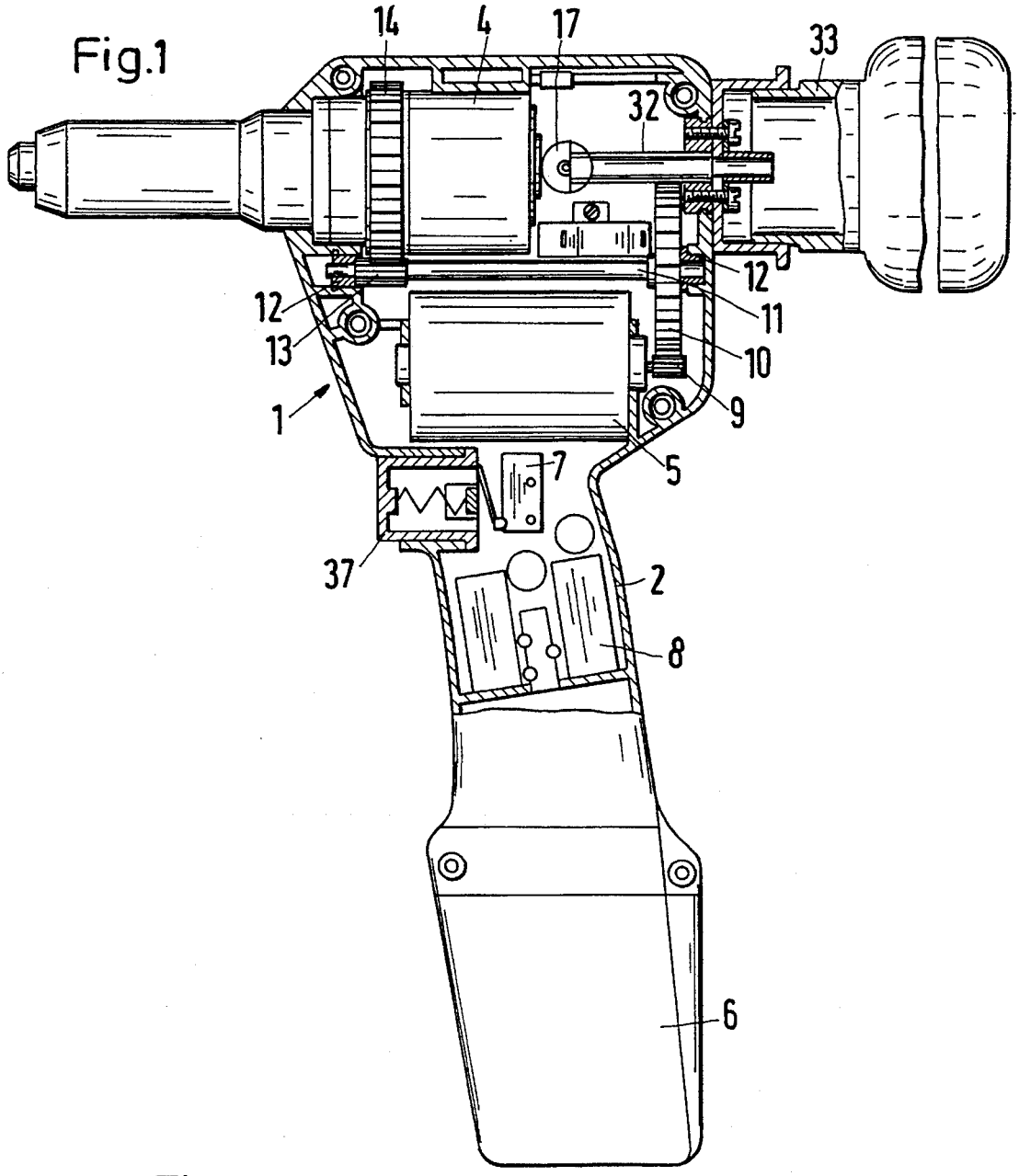
FIG. 1 is a partly elevational and partly central vertical sectional view of a power tool which embodies one form of the invention.
Figure 2:
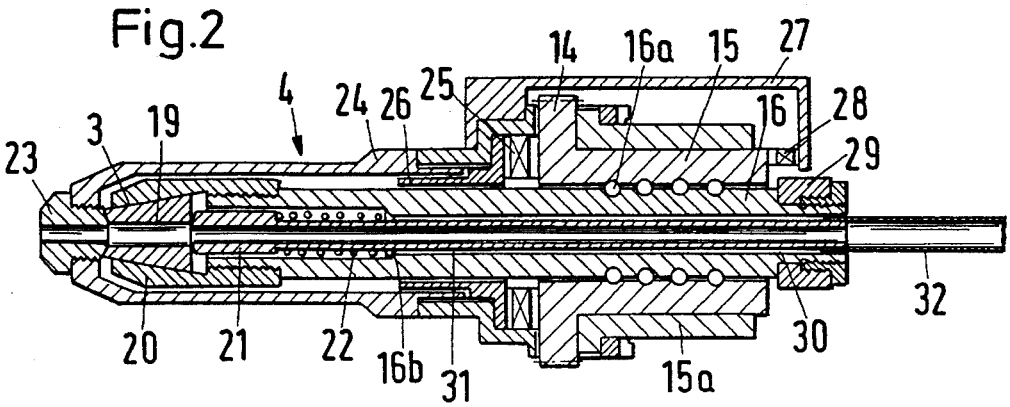
FIG. 2 is an enlarged longitudinal sectional view of a portion of the tool which is shown in FIG. 1.

The power tool 1 which is shown in FIGS. 1 to 4 comprises a housing 2 for a mandrel pulling unit 4 and for a reversible electric motor 5 forming part of means for moving a gripper 3 of the pulling unit 4 between an extended position which is shown in FIG. 2 and a retracted position to the right of the extended position of FIG. 2. The purpose of movement of the gripper 3 from the extended position is to sever (break) the mandrel of a blind rivet while the mandrel extends into the gripper by way of the axial inlet of a mouthpiece or nipple 23 installed in the housing 2 in front of the gripper. Mandrels which are to be severed by the gripper 3 in the pulling unit 4 are or can be of the type disclosed in the aforediscussed European Pat. No. 0 116 954 to Totsu or in the aforediscussed U.S. Pat. No. 4,085,337 to Moeller. The disclosures of these patents are incorporated herein by reference.

Figure 5:
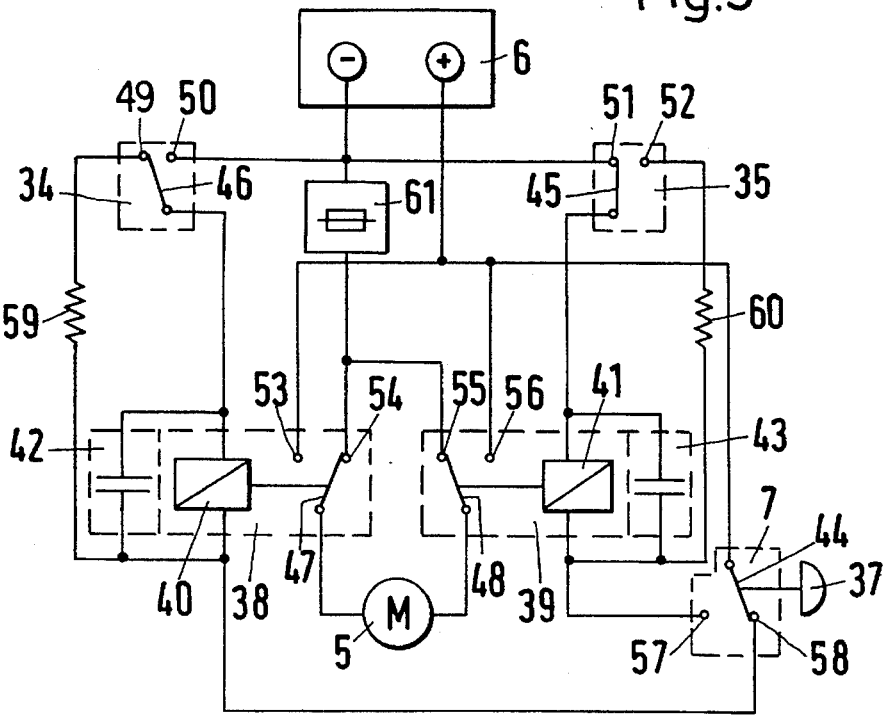
FIG. 5 is a diagram of the circuit and an on/off switch for the motor in the power tool of FIG. 1.

The housing 2 can be assembled of two substantially mirror symmetrical halves or shells made of suitable platic material. The energy source for the motor 5 is a battery or an accumulator 6 which is installed in or is appended to the handle of the housing 2. The housing 2 further contains an electric on/off switch 7 which forms part of an electric circuit 8 and can be actuated by a depressible trigger 37. The details of the circuit 8, which can connect the motor 5 with the energy source 6 in response to actuation of the switch 7, i.e., in response to depression of the trigger 37, are shown in FIG. 5.

The gripper 3 of the pulling unit 4 is reciprocable in the housing 2 by the rotary output element of the motor 5 by way of a transmission including a pinion 9 on the output element of the motor and a larger spur gear 10 meshing with the pinion 9 and mounted on a shaft 11 which is rotatably journalled in two bearings 12 in the housing 2. The transmission further comprises a pinion 13 on the shaft 11 and a ring gear 14 on a nut 15 which is rotatably mounted in the housing 2 and is held against axial movement therein. Still further, the transmission comprises a spindle or feed screw 16 (hereinafter called jack screw) which is non-rotatably but axially movably installed in the housing 2 and is connected with the gripper 3. Spherical antifriction rolling elements **16*a* are installed in the aligned helical grooves of the nut 15 and jack screw 16. The diameter of the pinion 13 is a fraction of the diameter of the spur gear 10 and of the ring gear 14. The character 15*a* denotes in FIG. 2 a sleeve which is installed in the housing 2 and surrounds the major portion of the nut 15, namely the portion which is adjacent the ring gear 14**.

The means for preventing rotation of the jack screw 16 in the housing 2 includes stops 17 which can constitute needle bearings movable back and forth in longitudinally extending tracks 18 provided therefor in the housing 2. This ensures that the gripper 3 and the jack screw 16 can move as a unit forwardly and backwards (toward and away from the mouthpiece 23) in response to rotation of the motor 5 in the corresponding direction, i.e., in response to rotation of the nut 15.

The gripper 3 is installed in the front portion of a barrel 24 constituted by a tubular rearward extension of the mouthpiece 23. The gripper 3 comprises two or more jaws 19 having conical external surfaces which diverge from the axis of the jack screw 16 in a direction away from the mouthpiece 23. The jaws 19 are confined in a chuck casing 20 having a complementary conical internal surface and being threadedly or otherwise connected to the front end portion of the jack screw 16. An annular pusher 21 is provided at the rear ends of the jaws 19 and is biased by a coil spring 22 which is confined in and reacts against an internal shoulder **16*b* of the jack screw 16. The spring 22 tends to maintain the conical external surfaces of the jaws 19 in contact with the conical internal surface of the chuck casing 20**.

When the gripper 3 including the jaws 19 assumes the extended position of FIG. 2, the front portions of the jaws 19 extend beyond the chuck casing 20 and abut the mouthpiece 23. If the jack screw 16 continues to move forwardly, such movement is shared by the chuck casing 20 whereby the spring 22 stores energy or additional energy because its rearmost convolution is pushed by the shoulder **16*b* but the foremost convolution comes to a standstill because the pusher 21 abuts the jaws 19 which, in turn, abut the mouthpiece 23. The internal surface of the chuck casing 20 moves forwardly with respect to the external surfaces of the jaws 19** so that the jaws are free to expand radially outwardly and to provide room for insertion of a fresh mandrel.

If the direction of rotation of the motor 5 is thereupon reversed, the jack screw 16 begins to move in a direction away from the mouthpiece 23 whereby the chuck casing 20 (which shares all axial movements of the jack screw 16) moves its internal surface relative to the external surfaces of the jaws 19. The jaws move radially inwardly and clamp the mandrel which has been inserted thereinto through the axial inlet of the mouthpiece 23. The chuck casing 20 thereupon entrains the jaws 19 and the clamped mandrel so that the head at the front end of the mandrel deforms the sleeve of the blind rivet and is ultimately severed as the jack screw 16 continues to move away from the extended position of FIG. 2. The severing takes place in front of the mouthpiece 23 and the severed rear portion of the mandrel is thereupon caused to enter a detachable collecting receptacle 33 at the rear end of a tube 32 having a front end portion telescoped into an axial passage 30 of the jack screw 16. Reference is again made to the European Pat. No. 0 116 954 to Totsu which fully describes and illustrates various stages of application of a blind rivet including breaking or severing of a mandrel as a result of movement of the gripper from its extended position.

The structure which is shown in FIG. 2 can be modified by designing the jaws 19 in such a way that they do not extend forwardly beyond the chuck casing 20 when the gripper 3 assumes its extended position. It is then desirable to provide the central portion of the mouthpiece 23 with a rearward extension which projects into the gripper 3 and serves as an abutment for the front end faces of the jaws 19 while the jack screw 16 and the chuck casing 20 continue to move forwardly in order to permit expansion of the gripper 3 and insertion of the rear portion of the mandrel of a fresh blind rivet.

The mouthpiece 23 is rigid with the inner case or barrel 24 which carries a thrust bearing 25 engaging the front end of the nut 15. Thus, when the jack screw 16 is caused to move rearwardly and pulls the mandrel in the gripper 3 in the same direction, the blind rivet exerts a force upon the mouthpiece 23 which, in turn transmits the force to the nut 15 by way of the barrel 24 and thrust bearing 25. Thus, the just discussed forces need not be taken up by the housing 2. Consequently, the power tool 1 can employ a relatively lightweight housing 2 which should be capable of taking up torsional stresses necessary to rotate the gear train 9, 10, 13, 14 and the nut 15. The thrust bearing 25 is further acted upon by an abutment 26 which is interposed between such bearing and the rear end portion of the chuck casing 20 when the jack screw 16 (which moves the chuck casing) reaches its fully retracted position. The thrust bearing 25 then arrests the jack screw 16 and transmits the force to the nut 15, i.e., not to the housing 2.

FIG. 2 further shows a cage 27 which at least partially confines the nut 15, and a thrust bearing 28 between the cage 27 and the rear axial end of the nut 15. The cage 27 is connected with the mouthpiece 23. When the jack screw 16 reaches its extended position, the pusher 21 urges the jaws 19 against the mouthpiece 23 which causes the cage 27 to urge the thrust bearing 28 against the rear axial end of the nut 15. Again, such forces are taken up by the nut 15 in lieu of the housing 2. The just discussed forces can reach a considerable magnitude if the jaws 19 tend to jam in the chuck casing 20, e.g., due to penetration of foreign matter or for any other reason.

The rear end portion of the jack screw 16 carries an abutment 29 which engages the nut 15 when the jack screw 16 reaches the extended position of FIG. 2. This ensures that the jack screw 16 is invariably arrested prior to reaching a position in which it would transmit forces to the extension 24 (by way of the chuck casing 20). This could result in overstressing of the cage 27 and/or other parts of the housing 2.

The illustrated passage 30 is an axial passage which extends through the entire jack screw 16 and forms part of a path for evacuation of severed portions of mandrels from the axial channel between the jaws 19 of the gripper 3 into the collecting receptacle 33. As can be seen in FIG. 2, the front end portion of the tube 32 is slidably telescoped into the adjacent rear end portion of the passage 30 to thus enable the jack screw 16 to perform movements between its extended and retracted positions. The path for evacuation of severed portions of mandrels further extends through the pusher 21 and the gripper 3. As a rule, the severed portion of a mandrel extends rearwardly at least in part into the pusher 21 and can be caused to slide rearwardly through the jack screw 16 and tube 32 into the receptacle 33 as soon as the jaws 19 release the front part of the severed portion.

The tube 32 is preferably adjustable in the housing 2 in the axial direction of the jack screw 16. This renders it possible to shorten or lengthen the path for evacuation of severed portions of mandrels. The pusher 21 has a tubular extension 31 which is telescoped into the front end portion of the tube 32.

As can be seen in FIG. 1, the rear portion of the tube 32 extends into the receptacle 33. This reduces the likelihood of penetration of severed mandrel portions back into the tube 32. It is also possible to remove the receptacle 33 or not to provide a receptacle at all. The rear end of the tube 32 then simply discharges a severed portion of a mandrel in response to proper orientation of the housing 2 so that the severed portion can slide into and beyond the tube 32 by gravity.

Figure 4:
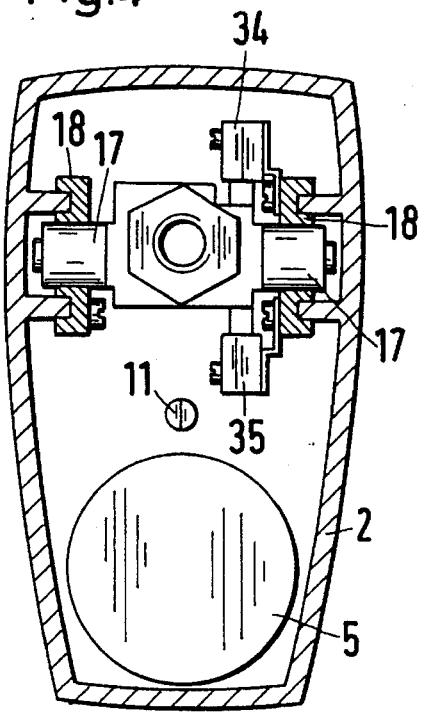
FIG. 4 is a sectional view substantially as seen in the direction of arrows from the line IV—IV in FIG. 3.
Figure 3:
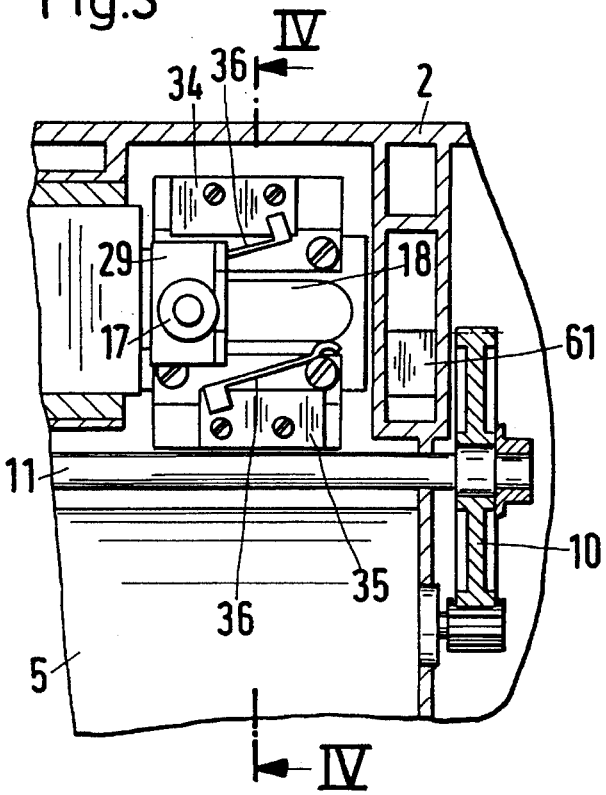
FIG. 3 is an enlarged fragmentary transverse sectional view of the tool.

As can be seen in FIGS. 3 and 4, the rear portion of the housing 2 contains two limit switches 34 and 35. The limit switch 34 is actuated in response to movement of the jack screw 16 to its extended position, and the limit switch 35 is actuated in response to movement of the jack screw to its other (retracted) end position. These switches form part of the circuit 8 which will be described with reference to FIG. 5. The arrangement is preferably such that the switches 34 and 35 are actuated shortly prior to advancement of the jack screw 16 to the respective (front end and rear end) positions; this ensures that the lack screw need not strike the respective abutment but comes to a halt without a pronounced impact. The illustrated limit switches 34 and 35 are mechanical switches which are actuated by suitable trips 36 located in the path of movement of the jack screw 16. However, it is equally within the purview of the invention to employ contactless electronic semiconductor switches or magnetically operable switching devices, such as protective gas contact switches.

The limit switch 34 ensures that the motor 5 is arrested and the forward movement of the jack screw 16 is terminated before the abutment 29 actually strikes the rear side of the nut 15, and the limit switch 35 ensures that the motor 5 is arrested before the abutment 26 actually strikes the front side of the nut. Thus, the abutments 26, 29 are utilized to positively arrest the jack screw 16 only as a last resort in the event of failure of the limit switches 34 and 35. These switches are not shown in FIG. 1 for the sake of clarity.

The circuit 8 of FIG. 5 comprises the aforementioned switches 7, 34 and 35, and the movable contacts (44, 46 and 45, respectively) of these switches are shown in the positions they assume when the jack screw 16 is maintained in its extended position as shown in FIG. 2. The positive pole of the energy source 6 (.e.g., an accumulator) is connected with the fixed contact 53 of a first signal generating switching device 38, with the movable contact 44 of the on/off switch 7, and with the fixed contact 56 of a second signal generating switching device 39. The devices 38 and 39 respectively comprise relays 40 and 41 which control the movable contacts 47, 48 of the respective switching devices. The movable contact 47 can engage the fixed contact 53 or 54 of the device 38, and the movable contact 48 can engage the fixed contact 55 or 56 of the device 39. The illustrated signal generating switching devices 38 and 39 can be replaced by semiconductor switches.

The negative pole of the accumulator 6 is connected with the fixed contacts 54, 55 of the respective switching devices 38, 39 and with the fixed contacts 50, 51 of the respective limit switches 34, 35. The movable contact 46 of the limit switch 34 is connected with a first control input of the switching device 38, and the fixed contact 49 of the limit switch 34 is connected with a second control input of the switching device 38 by a conductor containing a resistor 59. The switching device 38 is connected in parallel with a time delay 42 which is connected between the two control inputs of this device. For example, in its simplest form the time delay 42 can comprise a capacitor which is connected in parallel with the switching device 38.

The two control inputs of the switching device 39 are connected with a second time delay 43 (.e.g., a capacitor) which is connected in parallel with the device 39. One of these control inputs is connected with the movable contact 45 of the limit switch 35, and the other of these control inputs is connected with the fixed contact 52 of the limit switch 35 by a conductor containing a resistor 60.

Those control inputs of the signal generating switching devices 38, 39 which are not connected with the movable contacts 46, 45 of the limit switches 34, 35, respectively, are connected with the fixed contacts 58, 57 of the on/off switch 7. The movable contacts 47, 48 of the switching devices 38, 39 are in circuit with the motor 5. In the condition of the switching devices 38, 39 as shown in FIG. 5, the movable contact 47 is connected with the positive pole and the movable contact 48 is connected with the negative pole of the accumulator 6.

The entire circuit 8 of FIG. 5 can be replaced with any other suitable circuit, e.g., a circuit consisting of or containing electronic components, as long as the selected circuit is capable of performing the function of the circuit 8.

The operation of the improved power tool 1 is as follows:

As mentioned above, the lack screw 16 is assumed to be located in its extended position in which the corresponding trip 36 maintains the movable contact 46 in engagement with the fixed contact 49 and the movable contact 45 of the limit switch 35 engages the fixed contact 51. The operator is then free to introduce the mandrel of a fresh blind rivet into the pusher 21, i.e., through the axial inlet of the mouthpiece 23 and between the jaws 19 of the gripper 3. When the introduction of the mandrel into the pusher 21 is completed, the operator depresses the trigger 37 to shift the movable contact 44 of the on/off switch 7 from engagement with the fixed contact 58 into engagement with the fixed contact 57. The positive pole of the accumulator 6 is then connected with the negative pole through the movable contact 44 and fixed contact 57 of the switch 7, relay 41 of the signal generating switching device 39 and contacts 45, 51 of the limit switch 35. The relay 41 is energized and shifts the movable contact 48 of the switching device 39 from the fixed contact 55 toward engagement with the fixed contact 56. The circuit of the motor 5 is then completed from the positive pole of the accumulator 6, through the contacts 56, 48 of the switching device 39 and the contacts 47, 54 of the switching device 38. The motor 5 rotates the pinion 9 of the gear train further including the gear 10, pinion 13 and gear 14 in a direction to cause the rotating nut 15 to move the jack screw 16 from the extended position toward the retracted position. The mandrel in the hole of the pusher 20 is severed when the jack screw 16 covers a certain distance on its way away from the extended position of FIG. 2. Such distance depends upon the characteristics of the blind rivet and its mandrel. The movable contact 46 of the front limit switch 34 is free to leave the position of FIG. 5 and to engage the fixed contact 50 as soon as the jack screw 16 leaves its extended position.

The operator can release the trigger 37 when the severing of the mandrel is completed. The movable contact 44 of the on/off switch 7 then engages the fixed contact 58 to complete the circuit of the relay 40 in the signal generating switching device 38 from the positive pole of the accumulator 6, through the switch 7, the two inputs of the switching device 38 and the contacts 49, 50 of the limit switch 34. The energized relay 40 moves the contact 47 against the fixed contact 53. The circuit of the relay 41 of the signal generating switching device 39 is open as a result of movement of the contact 44 of the switch 7 from the contact 58 against the contact 57; however, the relay 41 remains energized for a period of time which is determined by the time delay 43. The motor 5 is then short circuited through the movable contact 47, fixed contacts 53, 56 and movable contact 48. The delay which is established by the time delay 43 is selected in such a way that it at least approximates the interval of time which is required to brake the motor 5 while the motor is idling and is not under load. Thus, when the motor 5 comes to a halt, the relay 41 moves the contact 48 again to the position of FIG. 5 in which the contact 48 engages the contact 55. The circuit of the motor 5 is then completed in the opposite direction, namely from the positive pole of the accumulator 6 through the contacts 53 and 47, the contacts 48, 55 and to the negative pole of the accumulator. Thus, the motor 5 is short circuited in immediate response to return movement of the contact 44 against the contact 58 of the on/off switch 7, and is thereupon reversed in an automatic way in order to return the jack screw 16 to the extended position. The jack screw 16 then actuates the trip 36 for the limit switch 34 so that the movable contact 46 of this switch engages the fixed contact 49. The time delay 42 abruptly discharges through the resistor 59 and the relay 40 is deenergized immediately to reestablish the short circuit for the motor 5 through the contacts 54 and 55. This permits abrupt braking of the motor 5 to thus ensure that the jack screw 16 comes to a halt at the extended position rather than as a result of engagement of abutment 29 with the nut 15.

If the operator of the power tool 1 fails to release the trigger 37 (for example, due to an oversight or for any other reason) before the jack screw 16 reaches the limit switch 35, the jack screw causes the trip 36 to actuate the limit switch 35 so that the movable contact 45 engages the fixed contact 52. This results in short circuiting of the time delay 43, and the relay 41 is deenergized to establish the short circuit path which is shown in FIG. 5. Thus, the motor 5 is braked in immediate response to actuation of the rear limit switch 35, and this results in abrupt stoppage of the jack screw 16 since the latter moves forwardly or backwards whenever the motor 5 is in the process of driving the pinion 9. If the operator thereupon releases the trigger 37, the circuit of the relay 40 is completed through the switches 34 and 7 so that the motor circuit is completed through the contacts 53 and 55. The motor 5 is then caused to rotate the pinion 9 in a direction to return the jack screw 16 to its extended position.

The purpose of the time delay 42 for the relay 40 of the signal generating switching device 38 is to short circuit the motor 5 if an operator happens to depress the trigger 37 at a time when the jack screw 16 is in the process of moving toward its extended position. Each of the time delays 42, 43 can ensure that the motor 5 is short circuited for a short interval of time before it changes the direction of its movement. This reduces the likelihood of the application of pronounced stresses to the motor 5 and to the parts which receive torque from the output element of the motor.

FIG. 5 shows that the limit switches 34 and 35 are acted upon only by relatively weak currents. This renders it possible to employ relatively small (compact) and simple limit switches.

An overload fuse 61 is provided to shield the motor 5. Such fuse can be set up to interrupt the supply of electrical energy to the motor 5 when the amplitude of the current exceeds a predetermined value for a predetermined interval of time.

An advantage of the improved power tool is that the person in charge can prevent unnecessary operation of the motor 5 in a simple and reliable manner. As a rule, the operator releases the trigger 37 as soon as the severing of a mandrel by the jaws 19 of the gripper 3 is completed; this automatically entails an operation of the motor 5 in reverse so that the jack screw 16 is caused to move back toward its extended position. The motor 5 is merely required to furnish torque which is necessary to sever a mandrel by the gripper 3, i.e., the motor is not required to charge an energy storing device while the jack screw 16 moves in a direction to ensure that the gripper 3 severs a mandrel. This renders it possible to employ a relatively small motor 5 whose energy requirements are low. The utilization of a small motor renders it possible to reduce the overall weight of the power tool 1 and to thus enhance the comfort to the person in charge of operating the tool. Furthermore, the power tool is particularly suitable for utilization with a portable energy source 6, i.e., it is not necessary to employ a cable to connect the circuit 8 to the outlet of a fixedly mounted energy source. The absence of a cable contributes to the versatility of the tool and to the convenience of manipulation. Still further, and since the energy requirements of the motor 5 are low, the energy which is supplied by a small portable source 6 suffices for the application of a large number of blind rivets without recharging or replacement.

Another advantage of the improved power tool is that the ratio of the transmission including the parts 9 to **16*a* is independent of the position of the gripper 3. Furthermore, the motor 5 and the transmission constitute the only means for moving the gripper 3 between its extended and retracted positions, i.e., there is no need to rely on springs and/or other parts which are necessary in conventional power tools. Therefore, the gripper 3 is called upon to perform only such movements which are needed to set a blind rivet and sever a mandrel but no further movements which would necessitate the consumption of additional energy and would result in additional wear upon the parts which move relative to each other. Thus, the strength of the motor 5** must be sufficient to sever a mandrel, and this can be achieved with a relatively small, lightweight, compact and inexpensive motor whose energy requirements are low.

Since the reversible motor 5 and the transmission including the parts 9 to **16*a* constitute the only means for moving the gripper 3, the latter can be moved back to the extended position from any intermediate position which the jack screw 16 assumes when the severing of a mandrel is completed. This ensures that the movement of the gripper 3 back to its starting position can be completed within a short interval of time so that the gripper is ready to engage the mandrel of a fresh blind rivet. The intervals of operation of the motor 5 are also reduced to a minimum, again due to the novel feature that the motor is permanently connected with the jack screw 16; this is desirable for obvious reasons, particularly because it brings about savings in energy which, in turn, renders it possible to utilize a portable energy source 6** for a long interval of time, i.e., for the setting of a large number of blind rivets. Thus, the energy source need not be recharged or replaced at frequent intervals.

A further important advantage of the improved power tool is that the motor 5 is prevented from performing any movements which would result in abrupt shifting of the jack screw 16 and gripper 3. This enhances the comfort to the operator of the power tool.

The assembly including the nut 15 and the jack screw 16 constitutes a presently preferred system for the establishment of a connection between the motor 5 and the gripper 3. This assembly converts rotary movements of the output element of the motor 5 into reciprocatory movements of the gripper 3. It is also possible to employ a transmission which comprises trapezoidal threads; however, the efficiency of the assembly of jack screw 16, nut 15 and rolling elements **16*a* is more satisfactory. Moreover, the assembly including the parts 15, 16 and 16*a* can transmit motion in either of two directions in such a way that the ratio of the transmission is not dependent upon the momentary position of the gripper 3**.

An advantage of an assembly wherein the nut rotates and the jack screw is caused to move back and forth in the axial direction is that the overall length of the assembly can be reduced. Reference may be had to the aforementioned U.S. Pat. No. 3,095,106 to Morrison which discloses a transmission comprising a rotary spindle and an axially movable nut. The overall length of the patented transmission exceeds the overall length of the assembly of nut 15 and jack screw 16 at least by the length of maximal stroke of the nut.

An advantage of the relatively large ring gear 14 on the nut 15 is that the lever arm is more satisfactory, i.e., the motor 5 is required to furnish a relatively small torque in order to rotate the nut 15 and to thus move the jack screw 16 and the gripper 3 toward and away from the mouthpiece 23.

It is possible to employ an at least partially solid lack screw 16, i.e., to eliminate the passage 30, the tube 31 and the receptacle 33. The provision of a passage 30 in the jack screw 16 is preferred at this time because this renders it possible to evacuate severed portions of mandrels at the rear end of the housing 2 in contrast to heretofore known proposals which involve evacuation through the front end of the housing. Such mode of disposing of severed portions of the mandrels contributes to a higher output of the power tool because the time which would be necessary to evacuate severed portions of mandrels through the mouthpiece can be used for introduction of a fresh mandrel.

An advantage of the ability of the jack screw 16 and its passage 30 to move relative to the tube 32 is that the length of the path for evacuation of the severed portion of a mandrel can be reduced to a minimum, i.e., the evacuation into the receptacle 33 can begin as soon as the severing step is completed and while the gripper 3 is spaced apart from its extended position. The length of the power tool does not change while the tool is in actual use, i.e., the length in actual use is the same as when the power tool is idle. This is desirable and advantageous when the space for the utilization of the power tool is limited. Evacuation of severed portions of mandrels into the receptacle 33 or out of the housing 2 at the rear end is not affected by the narrowness of space which is available for introduction of the power tool in order to apply one or more blind rivets to overlapping plates or to other types of workpieces.

The mouthpiece 23 bears against or abuts a blind rivet while the gripper 3 is operative to draw the mandrel until the mandrel breaks upon completed setting of the rivet. As mentioned above, the barrel 24 of the mouthpiece 23 transmits forces to the nut 15 by way of the thrust bearing 25. Thus, the dimensions of the nut 15 must be selected with a view to withstand the forces which develop during severing of a mandrel but such forces need not be transmitted to the housing 2 with advantages which were pointed out hereinbefore. The cage 27 cooperates with the thrust bearing 28 to transmit to the nut 15 forces which develop when the gripper 3 is about to reassume its extended position in which the jaws 19 are ready to engage a fresh mandrel. Such forces are not as pronounced as those which develop when the gripper 3 is about to sever a mandrel; nevertheless, they need not be taken up by the housing 2 because they are transmitted to the nut 15 through the cage 27 and thrust bearing 28. Thus, the only forces which the housing 2 must withstand are those acting upon the bearings for the nut 15 while the gear 14 is rotated by the motor 5.

The parts which are shown in FIG. 2 can be assembled into a prefabricated unit which is exchangeably installed in the housing 2. Such prefabricated unit can be installed in a lightweight housing because the housing need not take up forces which develop as a result of movement of the gripper between its extended and retracted positions and as a result of severing of a mandrel during movement of the gripper from its extended position.

The abutments 26 and 29 constitute a safety feature which prevents the jack screw 16 from applying unduly large forces directly to the housing 2. Otherwise stated, the abutments limit the extent of axial movability of the jack screw 16 relative to the nut 15. This enhances the comfort to the operator of the power tool and ensures that even a lightweight and relatively weak housing 2 suffices to adequately confine the prefabricated unit of FIG. 2, the circuit 8, the motor 5 and the energy source 6.

The aforediscussed operating means 7, 37, 8 for the motor 5 constitutes a novel and improved assembly which can be used with advantage in the improved power tool 1 as well as in conventional power tools wherein the ratio of the transmission between the motor and the gripper is dependent upon the momentary position of the gripper and wherein the motor is not operatively connected with the gripper during each and every stage of setting of a blind rivet. As described hereinabove, the circuit 8 is designed to move the jack screw 16 from the extended position toward the retracted position in response to depression of the trigger 37 (actuation of the on/off switch 7) and to automatically reverse the direction of movement of the jack screw 16 when the trigger 37 is released. This simplifies the task of the operator; such person simply introduces the mandrel of a blind rivet into and beyond the mouthpiece 23 while the rivet is properly positioned relative to the workpiece or workpieces. The trigger 37 is thereupon depressed and the motor 5 proceeds to advance the jack screw 16 and the gripper 3 from their extended positions. This movement continues until the mandrel is severed, i.e., until the setting of the rivet is completed. The trigger 37 is then released and the direction of rotation of the motor 5 is reversed in a fully automatic way to return the jack screw 16 and the gripper 3 to their extended positions. The severed portion of the mandrel is evacuated into the receptacle 33 and a fresh mandrel is introduced through the inlet of the mouthpiece 23.

Short-lasting short circuiting of the motor 5 when the trigger 37 is released brings about the aforediscussed advantages, i.e., the motor is rapidly decelerated before it begins to rotate its output element in the opposite direction. The braking action takes place while the circuit of the motor 5 is open. This reduces the electrical and mechanical stressing of the motor.

The switching devices 38 and 39 are controlled by the on/off switch 7. This is desirable and advantageous because the circuit 8 can employ relatively small switching devices which enhances the comfort to the operator who is required to exert a small force in order to depress the trigger 37 and to thus actuate the switch 7 which, in turn, controls the switching devices 38 and 39. An advantage of the feature that the time delays 42, 43 are operative for intervals which are required to decelerate the motor 5 while the motor is idling and is not under load is that the motor cannot be connected in circuit with the energy source 6 in a direction to rotate clockwise while it still rotates counterclockwise, or vice versa. This entails a pronounced reduction of wear upon various mechanical parts including bearings, gears and others. Therefore, the dimensions of such mechanical parts can be reduced accordingly. Each of the two switching devices 38, 39 controls a discrete short circuiting unit for the motor 5. This ensures that the motor can be short circuited irrespective of the momentary direction of rotation. Moreover, the short circuiting is achieved in a simple and inexpensive manner.

The limit switches 34 and 35 constitute an optional but desirable feature of the circuit 8. They are designed to interrupt the connection between the motor and the energy source 6 before the abutment 26 or 29 actually strikes the nut 15 and/or the housing 2. The limit switches deactivate the time delays 42, 43 when they are actuated by the jack screw 16. The reason is that the switching devices 38, 39 need not be actuated to reverse the direction of operation of the motor 5 when the latter reaches the extended or retracted position. The motor 5 should be decelerated, and this is achieved as a result of actuation of the limit switch 34 or 35. The limit switches are relatively small and compact because they are merely called upon to transmit signals rather than convey large currents.

The fuse 61 also constitutes an optional but desirable feature of the circuit 8. This fuse becomes effective (by disconnecting the motor 5 from the energy source 6) when the load upon the motor is likely to exceed an acceptable value, e.g., when the torque which is transmitted by the motor is so high that the motor consumes an excessive quantity of electrical energy.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A power tool for setting blind rivets by tensioning a mandrel of a blind rivet until the mandrel becomes severed, comprising a housing; a mandrel pulling unit disposed in said housing and comprising a gripper movable between an extended position for engagement with a mandrel and a retracted position to sever an engaged mandrel during movement from said extended position; and means for moving said gripper including an electric motor and a transmission interposed between said gripper and said motor within said housing, the electric motor being reversible and the transmission being permanently operatively coupled directly between the electric motor and the gripper such that the movement of the gripper in a first axial direction occurs without the use of a restoring spring when the electric motor rotates in a first direction and the movement of the gripper in an opposite second axial direction occurs without the use of a restoring spring when the electric motor rotates in an opposite second direction.

2. The power tool of claim 1, further comprising means for operating said motor, said motor and said transmission constituting the only means for moving the gripper between said positions thereof.

3. The power tool of claim 2, wherein said transmission comprises a spindle member, a nut member mating with said spindle member and antifriction rolling elements interposed between said members, one of said members being rotatable by said motor and the other of said members being reciprocable with said gripper.

4. The power tool of claim 3, wherein said one member is said nut member.

5. The power tool of claim 4, wherein said nut member comprises a gear and said transmission further comprises means for rotating said gear in response to operation of said motor.

6. The power tool of claim 3, wherein said gripper and said spindle member define a path for evacuation of a severed mandrel from said unit.

7. The power tool of claim 6, wherein said path includes a longitudinal passage in said spindle member.

8. The power tool of claim 7, wherein said housing comprises a tube for evacuation of severed mandrels from said path, said tube being telescoped into said passage and said spindle member being reciprocable with said gripper relative to said tube and said nut member.

9. The power tool of claim 3, further comprising a hollow mouthpiece provided in said housing and aligned with said gripper, and a thrust bearing between said mouthpiece and said nut member, said mouthpiece defining an inlet for introduction of a mandrel into said gripper.

10. The power tool of claim 3, wherein said spindle member is reciprocable with said gripper in response to rotation of said nut member by said motor, and further comprising at least one abutment reciprocable with said spindle member and being arrested by said nut member against further movement, in response to movement of said gripper and said spindle member to a predetermined end position relative to said housing and said nut member.

11. A power tool for setting blind rivets by tensioning a mandrel of a blind rivet until the mandrel becomes severed, comprising a housing; a mandrel pulling unit disposed in said housing and comprising a gripper movable between an extended position for engagement with a mandrel and a retracted position to sever an engaged mandrel during movement from said extended position; and means for moving said gripper including an electric motor and a transmission interposed between said gripper and said motor, the electric motor being reversible and the transmission being permanently operatively coupled directly between the electric motor and the gripper such that the movement of the gripper in a first axial direction occurs without the use of a restoring spring when the electric motor rotates in a first direction and the movement of the gripper in an opposite second axial direction occurs without the use of a restoring spring when the electric motor rotates in an opposite second direction;

means for operating said motor, said motor and said transmission constituting the only means for moving the gripper between said positions thereof;

a spindle member, a nut member mating with said spindle member and antifriction rolling elements interposed between said members, one of said members being rotatable by said motor and the other of said members being reciprocable with said gripper;

a hollow mouthpiece provided in said housing and aligned with said gripper, and a thrust bearing between said mouthpiece and said nut member, said mouthpiece defining an inlet for introduction of a mandrel into said gripper; and wherein said nut member has a first axial end and a second axial end, said mouthpiece being disposed at one axial end of said nut member, said housing comprising a cage at least partially confining said nut member and further comprising a second thrust bearing between said cage and the other axial end of said nut member.

12. A power tool for setting blind rivets by tensioning a mandrel of a blind rivet until the mandrel becomes severed, comprising a housing;

a mandrel pulling unit disposed in said housing and comprising a gripper movable between an extended position for engagement with a mandrel and a retracted position to sever an engaged mandrel during movement from said extended position; and means for moving said gripper including an electric motor and a transmission interposed between said gripper and said motor;

further comprising means for operating said motor, said motor and said transmission constituting the only means for moving the gripper between said positions thereof;

wherein said motor is reversible and said operating means includes an on/off switch actuatable by an operator and a circuit including means for operating said motor in a first direction in response to actuation of said switch and in a second direction in response to termination of actuation of said switch.

13. The power tool of claim 12, wherein said circuit further comprising means for short circuiting said motor for a predetermined interval of time in immediate response to termination of actuation of said switch.

14. The power tool of claim 12, wherein said circuit further comprises at least one signal generating switching device which is operable by said switch.

15. The power tool of claim 14, wherein said circuit further comprises means for delaying the generation of a signal by said at least one device in response to operation of said at least one device by said switch.

16. The power tool of claim 15, wherein said motor comes to a halt within a first interval of time in response to short circuiting by said short circuiting means, said delaying means being operative to delay the generation of a signal for a second interval of time which at least approximates said first interval.

17. The power tool of claim 12, wherein said circuit further comprises two discrete means for short circuiting said motor for predetermined intervals of time in response to termination of actuation of said switch.

18. The power tool of claim 17, wherein each of said short circuiting means comprises a switchover device.

19. The power tool of claim 12, wherein said transmission comprises a spindle member which is reciprocable by said motor and is connected with said gripper, and further comprising an energy source for said motor, said operating means comprising at least one limit switch having means for disconnecting said motor from said energy source in response to movement of said spindle member to a predetermined position.

20. The power tool of claim 19, wherein said operating means comprises a circuit including said at least one limit switch and a second switch actuatable by an operator to start said motor, said circuit further comprising at least one signal generating switching device which is operable by said second switch and means for delaying the generation of a signal by said at least one signal generating device for a predetermined interval of time in response to operation of said at least one device by said second switch, said at least one limit switch comprising means for deactivating said delaying means in response to movement of said spindle member to said predetermined position.

21. The power tool of claim 20, wherein said at least one signal generating switching device is operated by said at least one limit switch.

* * * * *